United States Patent [19]

Pickens

[11] Patent Number: 4,532,106

[45] Date of Patent: Jul. 30, 1985

[54] MECHANICALLY ALLOYED DISPERSION STRENGTHENED ALUMINUM-LITHIUM ALLOY

[75] Inventor: Joseph R. Pickens, Beltsville, Md.

[73] Assignee: Inco Alloys International, Inc., Huntington, W. Va.

[21] Appl. No.: 174,182

[22] Filed: Jul. 31, 1980

[51] Int. Cl.[3] ..... C22C 21/00

[52] U.S. Cl. ..... 420/528; 75/233; 419/19; 420/542; 420/547; 420/550

[58] Field of Search ..... 75/138, 203, 204, 206, 75/232, 233, 234, 235; 419/14, 17, 19

[56] References Cited

U.S. PATENT DOCUMENTS

| | | |
|---|---|---|
| 1,620,081 | 3/1927 | Czochralski et al. . |
| 1,620,082 | 3/1927 | Czochralski . |
| 2,381,219 | 8/1945 | Le Baron . |
| 3,563,730 | 2/1971 | Bach et al. . |
| 3,591,362 | 7/1971 | Benjamin . |
| 3,740,210 | 6/1973 | Bomford et al. . |
| 3,816,080 | 6/1974 | Bomford et al. . |

OTHER PUBLICATIONS

H. K. Hardy, "Trace-Element Effects in Some Precipitation-Hardening Aluminum Alloys", in Journal of the Inst. of Metals, vol. 84, pp. 429-439, 1955-1956.

L. P. Costas and R. P. Marshall, "The Solubility of Lithium in Aluminum", Trans. of the Met. Soc. of AIME, vol. 224, pp. 970-974, Oct. 1962.

Rare Metals Handbook, 2nd Ed., pp. 249-263, 1967.

G. E. Thompson and B. Noble, "Precipitation Characteristics of Aluminum-Lithium Alloys Containing Magnesium", Jnl. of the Inst. of Metals, vol. 101, pp. 111-115, 1973.

T. H. Sanders and E. S. Balmuth, "Aluminum-Lithium Alloys: Low Density", Metal Progress, pp. 32-37, Mar. 1978.

Charles T. Post, "New Aluminum Alloys Ready to Muscle in on Titanium", Iron Age, pp. 41-43, Jul. 3, 1978.

Craig Covault, "Aluminum Study Funds Sought", Aviation Week & Space Tech., pp. 14-15, Jul. 31, 1978.

Chem. Abst., vol. 66, 78565v, (1967).

Z. A. Sviderskaya and V. I. Kuz'mina, "Properties of Al-Li Alloys", Soviet J. Non-Ferrous Metals, vol. 9, #2, pp. 115-188, Feb. 1968.

I. N. Fridlyander et al., "New Light Alloys of Aluminum with Lithium and Magnesium", Nonferrous Metals and Alloys, pp. 211-212, Mar. 1968.

B. Noble and G. E. Thompson, "Precipitation Characteristics of Aluminum-Lithium Alloys", Metal Science Journal, vol. 5, pp. 114-120, 1971.

*Primary Examiner*—R. Dean

*Attorney, Agent, or Firm*—Raymond J. Kenny; Miriam W. Leff

[57] ABSTRACT

A dispersion-strengthened aluminum-base alloy system is provided which is prepared by mechanical alloying and is characterized by high strength, high elastic modulus, low density and high corrosion resistance. The alloy system is comprised, by weight, of at least above 1.5% up to about 3% Li, about 0.4% up to about 1.5% O, about 0.25% up to about 1.2% C, and the balance essentially Al.

20 Claims, 1 Drawing Figure

ELECTRICAL RESISTIVITY vs. w/o Li (measured by Chem. Analysis)

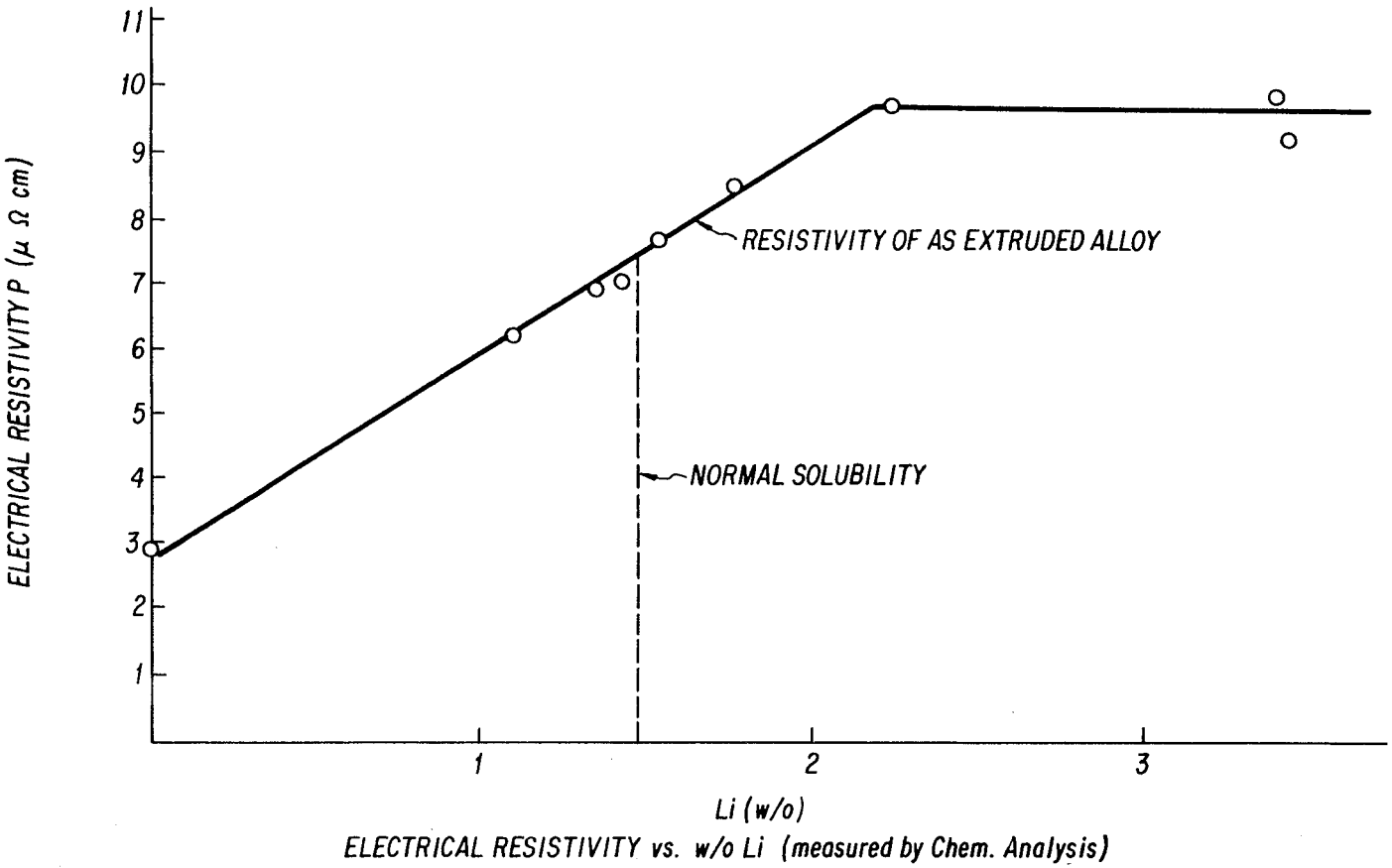
ELECTRICAL RESISTIVITY vs. w/o Li (measured by Chem. Analysis)

MECHANICALLY ALLOYED DISPERSION STRENGTHENED ALUMINUM-LITHIUM ALLOY

This invention relates to aluminum-base alloys and their preparation. More particularly it pertains to a dispersion strengthened Al-Li alloy system which is prepared by mechanical alloying and which is characterized by high strength, high specific modulus and high corrosion resistance.

BACKGROUND OF THE INVENTION

There is presently a demand in the aircraft industry for aluminum alloys which have high strength, high elastic modulus, low density and high corrosion resistance. For example, alloy 7075, a precipitation hardened alloy, is one of the current standards of the industry for various purposes. Aluminum alloys of higher strength and higher corrosion resistance than alloy 7075 are being sought, particularly for advanced designs. Because of the potential that the addition of lithium offers for improving properties of aluminum with respect to density and elastic modulus, several Al-Li containing alloy systems are presently under study. For example, T. H. Sanders and E. S. Balmuth have reported on three experimental alloys in "Metal Progress", pp. 32–37 (March 1978), viz. Al-Li containing 2.83 and 2.84 w/o (weight %) Li, Al-Cu-Li containing 1.5 w/o Li, and Al-Mg-Li containing 1.37 to 3.14 w/o Li. These alloys, which appear to be formed by "ingot metallurgy", i.e. from a melt, rely for their strength on the precipitation of the δ′ phase, $Al_3Li$. The δ′ phase coarsens at elevated temperature and transforms to the incoherent δ phase, less effective from the standpoint of strength of the alloy. It has been reported that the δ′ phase is known to coarsen rapidly at temperatures of about 200° C. This coarsening leads to lower stress rupture properties, and in general, would lead to lessened thermal stability. Furthermore, Al-Li alloys made by an ingot route suffer from severe oxidation during melting.

It has now been found that high strength, high specific modulus, dispersion strengthened Al-Li alloys which have good thermal stability can be made by a powder metallurgy technique known as mechanical alloying.

The mechanical alloying technique has been disclosed, for example, in U.S. Pat. Nos. 3,591,362; 3,740,210 and 3,816,080. These patents are incorporated herein by reference. Mechanical alloying, as described in the aforesaid patents, is a method for producing composite metal powders with a controlled, uniform fine microstructure. It occurs by the fracturing and rewelding of a mixture of powder particles during high energy impact milling, e.g., in an Attritor Grinding Mill. The process takes place entirely in the solid state. The repetitive cold welding and fracturing of the powder particles during mechanical alloying of the aluminum incorporates dispersoid materials, such as, for example, the naturally occurring oxides on the surface of the powder particles, into the interior of the composite powder particles. As the process continues the repetitive welding and fracturing of the powder particles, the incorporated dispersoid particles are reduced in size as they are homogeneously dispersed throughout the powder particles. In a similar fashion metallic alloy ingredients also are finely distributed within the powder particles. The powders produced by mechanical alloying are subsequently consolidated into bulk forms by various well known methods such as hot compaction followed by extrusion, rolling or forging.

U.S. Pat. Nos. 3,740,210 and 3,816,080 are specifically directed to mechanically alloyed aluminum systems and they disclose that one or more elements, among them Li, can be incorporated in the alloy system. By way of example, the patents mention that up to 1.5% lithium can be added. Various solubility limits of Li in Al at room temperature have been reported, e.g. 0.6, 0.7 and 1.5%. In the present invention, more than 1.5% Li is present, and there is lithium available to form a stable oxide. However, the level of Li is controlled to minimize or avoid phase precipitation which might lower the corrosion resistance of the alloy. Thus, the present invention enables the production of an aluminum alloy system with high strength, high specific modulus and excellent corrosion resistance and thermal stability. By thermal stability is meant that the room temperature strength is not affected by cycling to high temperature, i.e., a maximum of about 200° C. and back to room temperature. Furthermore, it enables the production of Li-containing Al alloys by a method which avoids problems of handling lithium which are present in melt techniques for making the alloy.

BRIEF DESCRIPTION OF INVENTION

In accordance with the present invention a dispersion strengthened mechanically alloyed aluminum-base alloy system is provided, which is characterized by high strength, high specific modulus, and high corrosion resistance consisting essentially, by weight, of at least above 1.5% up to about 3% Li, about 0.4% up to about 1.5% O, about 0.25% up to about 1.2% C, and the balance essentially aluminum.

As indicated above, the alloy is prepared by mechanical alloying, a high energy impact milling process, e.g., as disclosed in the aforementioned patents U.S. Pat. Nos. 3,740,210 and 3,816,080, and the high energy impact milling is carried out in the presence of a process control agent.

BRIEF DESCRIPTION OF FIGURE

The accompanying FIGURE is a graph which shows room temperature electrical resistivity as a function of lithium content.

PREFERRED EMBODIMENTS OF INVENTION

A. Composition Microstructure

The essential components of the dispersion strengthened aluminum-base alloy system of the present invention are aluminum, lithium, oxygen and carbon. A small percentage of these components are present in combination as insoluble dispersoids, e.g. as a lithium oxide. Other elements, e.g. magnesium, iron and copper may be incorporated in the alloy matrix, e.g. for solid solution strengthening, so long as they do not interfere with the desired properties of the alloy for a particular end use. Similarly, additional insoluble, stable dispersoid agents may be incorporated in the system, e.g. for high temperature strengthening of the system at elevated temperatures, so long as they do not otherwise adversely affect the alloy.

Lithium is present in an amount of at least above 1.5 up to about 3 w/o and preferably in an amount of above 1.5 w/o, e.g., about 1.51 w/o, or above 1.7 w/o, e.g., about 1.71 w/o, up to about 2.3 or 2.8 w/o. The lithium is present in an amount which exceeds its solubility limit in aluminum at room temperature, and at least a small fraction of lithium is believed to be present as a stable insoluble oxide which forms in-situ during mechanical alloying and/or consolidation and is uniformly distributed in the alloy matrix as dispersoid material. It is believed that this dispersoid is present in the form of lithium peroxide and that this oxide is at least in part a strength-contributing component of the alloy. Above about 2.3 w/o there is the strong possibility of forming lithium-containing intermetallic precipitates such as δ and the alloy may tend to become brittle. Any additional strength gained does not compensate for the loss in ductility, nor is additional strength needed for many applications. The lithium in the present system includes: (a) up to about 1.5 w/o lithium capable of being in equilibrium solution, (b) up to less than about 0.8 w/o of lithium believed to be in supersaturated solution, (although δ' formation is fascilitated by its low energy barrier of formation, the resistivity data suggest supersaturation. Recognize that competing processes e.g. the K effect, may explain this behavior also.) and (c) an amount of lithium necessary to tie up available oxygen as dispersoid, e.g. about 0.03 to 1.0 w/o, depending on the available oxygen content of the powder charge and total Li content.

The lithium is introduced into the alloy system as a powder (elemental or prealloyed with aluminum), thereby avoiding problems which accompany the melting of lithium.

The oxygen level is about 0.4 w/o up to about 1.5 w/o, preferably about 0.4 to about 1.0 w/o. The oxygen content should be sufficient to provide enough dispersoid for the desired level of strength without being so high as to reduce the lithium content in solution below the solubility limit, taking into account the lithium capable of being in supersaturated solution. When the Li level is at the low end of the range, e.g. about 1.6 w/o Li, the oxygen level may range to about 1.5 w/o, and when the Li level is high, e.g. 2.3 w/o, the oxygen level is preferably lower than about 1%, e.g. about 0.4 or 0.5 w/o.

The alloy may also contain up to about 1 w/o magnesium and up to about 0.3 or 0.5 w/o iron.

The carbon level is about 0.25 w/o up to about 1.2 w/o, preferably about 0.25 to about 0.7 w/o. The carbon is generally provided by a process control agent. Preferred process control agents are methanol, stearic acid, and graphite.

The dispersoid comprises an oxide and a carbide and are present in a range of a small but effective amount for increased strength up to about 6 v/o (volume %) or even as high as 8 volume %. Preferably the dispersoid level is as low as possible consistent with desired strength. Typically the dispersoid level is about 3 to 5 w/o. The dispersoid may be present, for example, as an oxide of lithium or aluminum. It is believed that $Li_2O_2$ is present as a dispersoid and that the δ' precipitate ($Al_3Li$) is not present in the alloy at Li levels up to about 2.3%. Even if δ' is present, it is not relied upon for strength in the alloy system of this invention. The dispersoids can be formed during the mechanical alloying step and/or consolidation. Possibly they may be added as such to the powder charge. Other dispersoids may be added or formed in-situ so long as they are stable in the aluminum-lithium matrix at the ultimate temperature of service. Examples of dispersoids that may be present at $Al_2O_3$, AlOOH, $Li_2O$, $Li_3AlO_2$, $LiAl_5O_8$, $Li_5AlO_4$, $Li_2O_2$ and $Al_4C_3$. The size of the dispersoid is very fine, e.g. it may be of the order of about 0.02 μm, and it is uniformly dispersed throughout the alloy powder. It is believed the fine grain size of the alloy which is of the order of about 0.1 μm, is at least in part, responsible for this high room temperature strength of the alloy.

B. Alloy Preparation (1) Mechanical Alloying

Powder compositions treated in accordance with the present invention are all prepared by a mechanical alloying technique. This technique is a high energy milling process, which is described in the aforementioned patents incorporated herein by reference. Briefly, aluminum powder is prepared by subjecting a powder charge to dry, high energy milling in the presence of a grinding media, e.g. balls, and a process control agent, under conditions sufficient to comminute the powder particles of the charge, and through a combination of comminution and welding actions caused repeatedly by the milling, to create new, dense composite particles containing fragments of the initial powder materials intimately associated and uniformly interdispersed. Milling is done under an argon or nitrogen blanket, thereby facilitating oxygen control since virtually the only sources of oxygen are the starting powders and the process control agent. The process control agent is a weld-controlling amount of a carbon-contributing agent and may be, for example, graphite or a volatilizable oxygen-containing hydrocarbon such as organic acids, alcohols, heptanes, aldehydes and ethers. The formation of dispersion strengthened mechanically alloyed aluminum is given in detail in U.S. Pat. Nos. 3,740,210 and 3,816,080, mentioned above. Suitably the powder is prepared in an attritor using a ball-to-powder weight ratio of 15:1 to 60:1. The process control agent is added at various times during the run based on ball-to-powder ratio, starting powder, size, mill temperature, etc. As indicated above, preferable process control agents are methanol, stearic acid, and graphite. Carbon from these organic compounds and/or graphite is incorporated in the powder and contributes to the dispersoid content.

(2) Degassing and Consolidation

Before the dispersion strengthened mechanically alloyed powder is consolidated by a thermomechanical treatment, it must be degassed. A compaction step may or may not be used. Degassing is carried out at a temperature of about 220° to about 600° C., consolidated at about 220° to about 600° C., and preferably at about 500° C. One preferred powder consolidation practice is to can, high temperature degas, e.g. at 510° C. (950° F.), hot compact and extrude at about 315° to about 510° C. (600°-900° F.).

It is believed that the preferred conditions produce an alloy which is strengthened by an extremely fine grain size, a high dislocation density, a fine uniform dispersion of a lithium/oxygen-containing compound, and a dispersion of a carbon-containing compound (most probably $Al_4C_3$). A contribution to strength is caused by solid solution strengthening by lithium. The lithium present in solid solution (equilibrium solute±supersaturation content) and present as an oxygen-containing dispersoid contribute to the high specific modulus.

In addition to high strength, low density and high elastic modulus, the dispersion strengthened alloy has excellent corrosion resistance, excellent stress corrosion cracking resistance, and excellent thermal stability.

The invention is further described, but not limited to the illustrative examples which follow.

Samples of dispersion strengthened mechanically alloyed aluminum-lithium were prepared by high energy impact milling a mixture of powders in a 4 gallon attritor for 6 to 18 hours at various ball-to-powder weight ratios (B/P) (e.g. 20 to 50) under a blanket of nitrogen or argon and in the presence of either methanol (M) or stearic acid (S) as the process control agent (PCA). The PCA, which is introduced through: (1) discrete additions and (2) absorption through attriting atmosphere when the atmosphere is bubbled through a PCA-containing flask ("the bubbler"), is believed to produce at least a part of the dispersoid. The resultant powders were canned, then vacuum degassed and compacted at 510° C. (950° F.) and extruded to ⅝" rod at a temperature of 343° or 427° C. (650° or 800° F.). Each heat was analyzed for composition either of the powder and rod or both. Tests were performed to determine physical and electrical properties and the nature of the dispersoid. Analysis and results of various tests are shown in the Tables below.

Processing details for making various powder heats are given in Table I. Compositions, and hardness data, given as the Brinell hardness of the consolidated billets (Can BHN) at 500 and 3000 kg load, are also tabulated in Table I. The heats were compacted at 950° F. after a 3 hour vacuum degas, except for heats 13 and 14, which were compacted at 950° F. after a 4 hour vacuum degas.

Results of room temperature tests on samples of heats identified in Table I and extruded to rod are tabulated in Table II. The room temperature data shown are ultimate tensile strength (UTS), yield strength (YS), % elongation (% El), % reduction of area (% RA), elastic modulus (E), density ($\rho$), specific modulus ($E/\rho$).

TABLE I

| Powder Prep | | | | | | Composition, w/o | | | | | Can BHN | |
|---|---|---|---|---|---|---|---|---|---|---|---|---|
| Heat | PCA | Atm | Hours Bubbler | B/P | Att. Time (hrs) | Li | O | C | Fe | Other | 500 | 3000 |
| 1 | 1.4 M | N | 0 | 20 | 16 | 1.52* | .95* | .67* | .06 | .20 Mg | 184 | 209 |
| 2 | .6 M | N | 0 | 20 | 16 | 1.53* | 1.04 | .29 | .28 | 3.59 Mg | 247 | 277 |
| 3 | 1.0 M | Ar | 0 | 50 | 8 | 1.12* | 1.53* | .84* | | .72 Mg | 204 | 237 |
| 4 | 1.0 M | Ar | 1½ | 40 | 8 | 1.46* | 2.12* | 1.12* | .15 | | 169 | 205 |
| 5 | 1.0 M | Ar | 0 | 40 | 8 | 2.35* | 1.16* | .54 | .18 | | 154 | 174 |
| 6 | 1.1 M | Ar | 3¼ | 40 | 8 | 1.67 | 1.48 | .58 | .20 | | 158 | 183 |
| 7 | .7 M | Ar | 4 | 40 | 8 | 1.62* | 1.10* | .70 | .11 | | 180 | 212 |
| 8 | .3 M | Ar | 4 | 40 | 9 | 3.44* | 1.58 | 1.35 | .12 | | 180 | 205 |
| 9 | .3 M | Ar | 2½ | 40 | | 3.47* | 1.32 | .73 | .17 | | 180 | 214 |
| 10 | .3 M | Ar | 6¾ | 40 | 6¾ | 1.83 | .60* | .32 | .17 | | 136 | 148 |
| 11 | .5 S | Ar | 0 | 40 | 6.2 | 1.74* | .44* | .40 | .24 | | 143 | 156 |
| 12 | 1.2 S | Ar | 0 | 20 | 8 | 1.53* | .45 | .72 | .11 | | 172 | 187 |
| 13 | 1.0 M | N | ½ | 20 | 18 | 1.74 | 1.40 | .54 | | | 206 | |
| 14 | 1.0 M | N | 9½ | 30 | 12 | 1.87 | 1.49 | .78 | .073 | | 195 | |
| 15 | .5 S | Ar | 0 | 40 | 4 | 2.6* | 1.13* | .49 | .06 | | 156 | 156 |
| 16 | 1.2 M | Ar | 0 | 40 | 4 | 2.2 | .68 | .43 | | | — | — |
| 17 | .6 M | Ar | 0 | 40 | 4 | 1.93 | .45 | .26 | .08 | | 124 | 124 |

*Analysis of Chips from extruded rod. Other analysis is of the powder

TABLE II

| Heat | Ext °F. | YS KSI | UTS KSI | % EL | % RA | E psi × $10^6$ | $\rho$ g/cm$^3$ | $E/\rho$ in × $10^6$ |
|---|---|---|---|---|---|---|---|---|
| 1 | 650 | 93.7 | 112.1 | 2½ | 2 | 11.4/11.7 | 2.63 | 120 |
| 2 | 650 | NDO | 42.6 | Nil | Nil | 12.0 | 2.619 | 126 |
| 3 | 650 | 90.6 | 98.9 | <1 | 1.5 | 11.2 | 2.638 | 118 |
| 4 | 800 | 79.4 | 92.1 | 1 | 3½ | 12.0 | 2.61 | 127 |
| 5 | 650 | NDO | 68.7 | Nil | Nil | 12.2 | 2.53 | 133 |
| 6 | 650 | 68.8 | 84.4 | 5 | 17 | 10.7 | 2.65 | 114 |
| 7 | 800 | 75.2 | 91.7 | 2½ | 7½ | 11.2 | 2.597 | 118 |
| 8 | 650 | NDO | 38.2 | Nil | Nil | 11.2 | 2.48 | 125 |
| 9 | 800 | NDO | 21.5 | Nil | Nil | 11.8 | 2.458 | 133 |
| 10 | 650 | 55.9 | 63.1 | 9½ | 37¼ | N.D. | 2.567 | 114 |
| 11 | 650 | 61.7 | 65.4 | 7½ | 29½ | 10.1 | 2.477 | 116 |
| 12 | 650 | 69.6 | 83.6 | 3 | 11 | 11.0 | 2.61 | 117 |
| 13 | 800 | NDO | 37.7 | Nil | Nil | ND | ND | ND |
| 14 | 800 | NDO | 29.5 | Nil | Nil | ND | ND | ND |
| 15 | 650 | 67.5 | 76.5 | 2 | 6 | 11.6 | 2.53$^e$ | 127$^e$ |
| 17 | 650 | 55.1 | 58.5 | 13 | 38½ | 11.7 | 2.57$^e$ | 126$^e$ |

ND = No data
NDO = 0.2% offset not attained before fracture
e = Estimated

Heats 1, 6, 7, 10, 11, 12, 15 and 17 in Tables I and II illustrate alloys of the present invention. They have lithium levels between about 1.5 and 2.6 w/o and an O level between about 0.4 and 1.5 w/o show, and in room temperature tests show a tensile strength greater than 55 ksi (tensile elongation between about 2 and 13%) and a specific modulus of at least $114\times10^6$ (between 114 and $128\times10^{-6}$). Alloys of the present invention have a lithium content above the solubility limit and the oxygen content should be high enough to form sufficient dispersoid for the desired level of strength. Higher oxygen content is not necessary and may impair ductility, as in the case of Heat 4. The oxygen level should be considered relative to the Li level, as in heat 4. The presence of small amounts of Mg may increase the strength. However, it appears from the data that alloys of the present system which have a high specific modulus, such as shown in Heats 6, 7, 10, 11 and 12, have sufficiently high strength without magnesium. From the data it appears that the allowable magnesium content is governed at least in part by the oxygen content. Heat 3, for example, has a magnesium level of 0.72 w/o coupled with an oxygen content of 1.53 w/o and the ductility is poor. With higher amounts of Mg, e.g., Heat 2, even less oxygen and carbon could be tolerated.

Samples of extruded rod were submitted to a corrosive environment test consisting of alternate immersion in an aqueous solution of 35 w/o NaCl at 35° C. Table III shows corrosion rates of samples of alloys of the present invention (Samples A and B) having the composition of Heats 7 and 10 of Table I (containing 1.6 and 1.8 w/o Li, respectively). For comparison corrosion data are given for a sample of Heat 9 (3.5 w/o) Li (Sample X), a commercial corrosion resistant alloy 5083, alloy 7075, and a sample of electrically conductive aluminum (EC Al).

The data of Table III show the corrosion resistance of alloys of present invention is as good as known corrosion resistant alloy, viz 5083, and superior to alloy 7075.

TABLE III

| Sample | Condition | Exposure (d) | Corrosion Rate (mdd) |
|---|---|---|---|
| A | As extruded | 30 | 0.434 |
| | " | 90 | 0.271 |
| | 343° C./1 hr./FC | 30 | 0.252 |
| | " | 90 | 0.276 |
| B | As extruded | 30 | 0.257 |
| | " | 90 | 0.165 |
| | 343° C./1 hr./FC | 30 | 0.184 |
| | " | 90 | 0.442* |
| X | As extruded | 30 | 0.508* |
| | " | 90 | 0.448* |
| | 343° C./1 hr/FC | 30 | 0.450* |
| | " | 90 | 0.250* |
| Alloy | H-112 | 30 | 0.833 |
| 5083 | | 90 | 0.583 |
| | | 90 | 0.446 |
| Alloy | T-651 | 30 | 12.45(1) |
| 7075 | | 90 | 7.06(1) |
| (Al- | | 30 | 5.05(2) |
| clad) | | 90 | 3.75(2) |
| EC | (Unknown) | 30 | 0.657 |
| AL | | 90 | 0.406 |

*Cracking noted
(1) Edges were coated with sealant.
(2) Edges were not coated with sealant.
(d) = days
(mdd) = milligrams/decimeter$^2$/day Samples of extruded rod were subjected to alternate immersion stress corrosion cracking tests (SCC) in 3.5 w/o NaCl at 35° C., 10 minutes immersion and 15 minutes out, for 45 days while loaded at or near the yield stress. Table IV shows SCC data obtained on samples having the compositions of Heats 7, 10 and 11 of Table I, identified as Samples D, F and G, respectively. For comparison tests a sample of alloy 7075 are shown.

TABLE IV

| Sample | YS (KSI) | Loading (% of YS) | Time to Failure hrs. |
|---|---|---|---|
| D | 75.4 | 100 | Broke on loading |
| | 75.4 | 90 | " |
| F | 55.9 | 100 | >1138.8* |
| G | 61.7 | 100 | >1108.8* |
| 7075-1 | | 80 | 36.1 |
| 7075-2 | | 90 | 30.4 |
| 7075-3 | | 100 | 17.5 |
| 7075-4 | | 100 | 17.9 |

*Removed from test - failure occured

The data in Table IV show that alloys F and G of this invention showed excellent resistance to stress corrosion cracking even when loaded at the yield stress.

Studies were carried out, e.g. electron diffraction patterns of foil of a sample the composition of Heat 1 and X-ray diffraction data on extruded rod of a sample of composition of Heat 2, to determine the nature of the dispersoid. Electron diffraction patterns on TEM foils and X-ray diffraction data suggest, although not conclusively, that the dispersoid is $Li_2O_2$.

Tests on samples H and I having the compositions of Heats 7 and 11, respectively, showed no loss in room temperature strength after 100 hr. exposure at 275° F.

| Sample | UTS (As-Extruded) | UTS 275 (100) |
|---|---|---|
| H | 91.7 | 92.5 |
| I | 65.4 | 64.4 |

Electrical resistivity as a function of Li content was measured for various samples, and the data plotted in the accompanying FIGURE. The data indicate that: (a) supersaturation occurs above the 1.5 w/o solubility limit of Li in Al; (b) supersaturation of up to 0.8 w/o Li has been achieved (2.3 w/o Li total), and (c) some Li is tied up as an incoherent dispersoid rather than the δ' coherent precipitate.

Transmission electron microscopic observation of a sample having a composition of Heat 1 of Table I showed it had a grain size of about 0.1 μm. Elevated temperature tensile strength showed a sharp drop in strength with temperature. Present indications are that the alloy system is suited for use at room temperature up to about 93° C. (200° F.) and that temperature excursions up to about 195° C. (383° F.) or possibly greater do not change the room temperature strength.

Although the present invention has been described in conjunction with preferred embodiments, it is to be understood that modifications and variations may be resorted to without departing from the spirit and scope of the invention, as those skilled in the art will readily understand. Such modifications and variations are considered to be within purview and scope of the invention and appended claims.

What is claimed is:

1. A dispersion strengthened mechanically alloyed aluminum-base alloy, consisting essentially, by weight, based on consolidated form of from about 1.7% up to about 3% lithium, from about 0.4% up to about 1.5% oxygen, from about 0.25% up to about 1.2% carbon, and the balance essentially aluminum, said alloy being characterized in consolidated form by a combination of a room temperature yield strength of at least about 55 ksi, an elongation of at least 2%, a specific modulus of at least about $114\times10^6$ inches and resistance to corrosion, with the proviso that when the yield strength is less than about 60 ksi, then the % elongation is greater than 3%.

2. An alloy according to claim 1, wherein the dispersoid comprises a lithium oxide.

3. An alloy according to claim 1, wherein the dispersoid comprises $Li_2O_2$.

4. An alloy according to claim 1, wherein the Li is present in the system in solid solution and as an oxide dispersoid.

5. An alloy according to claim 4, wherein up to 0.8% of the lithium present is in supersaturated solution.

6. An alloy according to claim 1, wherein the lithium content is about 1.7% to about 2.8%.

7. An alloy according to claim 6, wherein the lithium level is at least above 1.7%.

8. An alloy according to claim 1, wherein the oxygen content is about 0.4 to about 1%.

9. An alloy according to claim 1 consisting essentially of about 1.7 to about 2.3% lithium, about 0.4 to about 1.5% oxygen, about 0.3 to about 0.8% carbon and up to about 0.3% iron.

10. An alloy according to claim 1, wherein the dispersoid level is up to 6 volume %.

11. An alloy according to claim 10, wherein the dispersoid level is about 3 to 5 volume %.

12. An alloy according to claim 1, containing at least one of the elements Mg and Fe.

13. An alloy according to claim 1, consisting essentially, by weight, of about 1.7 to about 2.8% Li, about 0.4 to 1% O, about 0.25 to 0.7% C, up to about 1% of magnesium and up to about 0.5% iron, and the balance essentially aluminum, said magnesium and iron components being correlated with the level of lithium.

14. An alloy according to claim 13, wherein the lithium level is at least above 1.7%.

15. In a powder metallurgy method of producing a consolidated aluminum-lithium product having high strength and high specific modulus comprising dry milling a powder charge in the presence of a process control agent to provide a mechanically alloyed powder, degassing the powder at a temperature of about 200° to 600° C., and consolidating the product, the improvement comprising mechanically alloying a powder charge composition consisting essentially by weight based on consolidated form, of from about 1.7% up to about 3% lithium, from about 0.4% up to about 1.5% oxygen, from about 0.25% up to about 1.2% carbon and the balance essentially aluminum, said alloy being characterized in consolidated form by a combination of a room temperature yield strength of at least about 55 ksi, an elongation of at least 2%, a specific modulus of at least about $114\times10^6$ inches and corrosion resistance, with the provisio that when the yield strength is less than about 60 ksi, then the % elongation is greater than 3%.

16. A powder metallurgy method according to claim 15, wherein the degassed powder is hot consolidated at a temperature of about 220° C. to about 600° C.

17. A consolidated product prepared by the method of claim 15.

18. A dispersion strengthened mechanically alloyed aluminum-base alloy, consisting essentially, by weight, based on consolidated form of from about 1.7% up to about 3% lithium, from about 0.4% up to about 1.5% oxygen, from about 0.25% to about 1.2% carbon, and the balance essentially aluminum, with the proviso that the oxygen content is only sufficiently high to provide the desired strength, said alloy being characterized in consolidated form by a combination of a room temperature yield strength of at least about 55 ksi, an elongation of at least 2%, a specific modulus of at least about $114\times10^6$ inches and resistance to corrosion.

19. A dispersion strengthened mechanically alloyed aluminum-base alloy, consisting essentially, by weight, based on consolidated form of from about 1.7% up to about 3% lithium, from about 0.4% up to about 1.5% oxygen, from about 0.25% up to about 1.2% carbon, and the balance essentially aluminum, said alloy being characterized in consolidated form by a combination of a room temperature yield strength of at least about 55 ksi, an elongation of at least 2%, a specific modulus of at least about $114\times10^6$ inches and resistance to corrosion, with the proviso that when yield strength is less than 60 ksi then the % elongation is greater than 7½%.

20. A dispersion strengthened mechanically alloyed aluminum-base alloy, consisting essentially, by weight, based on consolidated form from about 1.7% up to about 3% lithium, from about 0.4% up to about 1.5% oxygen, from about 0.25% up to about 1.2% carbon, and the balance essentially aluminum, with the proviso that when the lithium level is at the low end of the range, the oxygen level may range up to about 1.5% and when the lithium level is at the high end of the range, the oxygen level is lower than about 1%, said alloy being characterized in consolidated form by a combination of a room temperature yield strength of at least about 55 ksi, an elongation of at least 2%, a specific modulus of at least about $114\times10^6$ inches and resistance to corrosion, with the proviso that when yield strength is less than 60 ksi then the % elongation is greater than 3%.

* * * * *